US009470450B2

(12) United States Patent
Do

(10) Patent No.: US 9,470,450 B2
(45) Date of Patent: Oct. 18, 2016

(54) REFRIGERATOR HAVING CURVED DOOR EDGES AND METHOD OF MANUFACTURING THE SAME

(71) Applicant: Dongbu Daewoo Electronics Corporation, Seoul (KR)

(72) Inventor: Man Sung Do, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 14/593,874

(22) Filed: Jan. 9, 2015

(65) Prior Publication Data

US 2016/0138852 A1 May 19, 2016

(30) Foreign Application Priority Data

Nov. 14, 2014 (KR) ..... 10-2014-0158571

(51) Int. Cl.

| | |
|---|---|
| ***F25D 23/00*** | (2006.01) |
| ***F25D 23/02*** | (2006.01) |
| ***F25D 23/08*** | (2006.01) |
| ***E05D 15/00*** | (2006.01) |

(52) U.S. Cl.

CPC ..... *F25D 23/028* (2013.01); *E05D 15/00* (2013.01); *F25D 23/08* (2013.01); *F25D 2201/10* (2013.01)

(58) Field of Classification Search

CPC .. F25D 2323/02; F25D 23/02; F25D 23/028; F25D 2201/10; E05D 15/00

USPC ..... 312/405, 326, 329; 49/381, 383, 384, 49/502

See application file for complete search history.

(56) References Cited

U.S. PATENT DOCUMENTS

| | | | | | |
|---|---|---|---|---|---|
| 2,394,134 | A * | 2/1946 | Ayres | F16L 59/00 | 217/128 |
| 2,553,832 | A * | 5/1951 | Richard | F25D 23/082 | 49/484.1 |
| 2,639,592 | A * | 5/1953 | Philipp | F25D 11/025 | 312/406 |
| 2,760,301 | A * | 8/1956 | Derr | F25D 23/082 | 160/383 |
| 2,793,781 | A * | 5/1957 | Morton | F25D 23/085 | 220/592.06 |
| 2,837,816 | A * | 6/1958 | Saunders | B21D 53/00 | 29/414 |
| 2,839,347 | A * | 6/1958 | Strub | F25D 23/04 | 312/321.5 |
| 2,840,433 | A * | 6/1958 | Richard | F25D 23/04 | 312/321.5 |
| 5,056,332 | A * | 10/1991 | Tajima | F25D 17/065 | 312/116 |
| 5,533,311 | A * | 7/1996 | Tirrell | B29C 51/267 | 312/405 |

(Continued)

FOREIGN PATENT DOCUMENTS

| | | | |
|---|---|---|---|
| JP | 2001116431 | * | 4/2001 |
| JP | 2001116435 | * | 4/2001 |

(Continued)

*Primary Examiner* — Janet M Wilkens

(57) ABSTRACT

A refrigerator decreasing the space needed to opened a door by forming a curvature at an edge of the door and decreasing risk of an accident or injury caused when a body part is caught between the door and a wall, and a method of manufacturing the same, are disclosed according to embodiments of the present invention. The durability of the door may be improved by forming a curvature of the door edge so that a curvature radius of an upper side of the door is greater than a curvature radius of a lower side of the door.

6 Claims, 7 Drawing Sheets

(56) References Cited

U.S. PATENT DOCUMENTS

| | | | | |
|---|---|---|---|---|
| 5,584,547 | A * | 12/1996 | Trulaske, Sr. | A47F 3/0434 312/114 |
| 6,209,265 | B1 * | 4/2001 | Banicevic | F25D 23/02 49/382 |
| 2008/0174218 | A1 * | 7/2008 | Leimkuehler | F25D 23/02 312/405 |
| 2008/0174220 | A1 * | 7/2008 | Kim | F25C 5/005 312/405 |
| 2009/0015124 | A1 * | 1/2009 | Yang | F25D 23/028 312/405 |
| 2009/0229297 | A1 * | 9/2009 | Allard | F25D 23/02 62/449 |
| 2010/0156260 | A1 * | 6/2010 | Arzoz Barandalla | F25D 23/028 312/405 |

FOREIGN PATENT DOCUMENTS

| | | | |
|---|---|---|---|
| JP | 2002340474 | * | 11/2002 |
| JP | 2010065860 | * | 3/2010 |

* cited by examiner

REFRIGERATOR HAVING CURVED DOOR EDGES AND METHOD OF MANUFACTURING THE SAME

CROSS-REFERENCE TO RELATED APPLICATIONS

This application claims benefit and priority from Korean Patent Application No. 10-2014-0158571, filed on Nov. 14, 2014, with the Korean Intellectual Property Office, the disclosure of which is incorporated herein in its entirety by reference.

TECHNICAL FIELD

The present disclosure relates to a refrigerator and a method of manufacturing the same, and more particularly, to a refrigerator design which reduces the space required to open and close its door, and is capable of preventing injury caused by a body part being caught between its door and a wall, and a method of manufacturing the same.

BACKGROUND

In general, a refrigerator includes storage spaces for keeping food cold. The storage spaces are covered with doors that may be opened and closed. The doors may be attached to the front of the refrigerator using a hinge, and thus a wide space around the refrigerator is necessary for opening the doors.

Specifically, when viewing the refrigerator from the top down, edges of the door of the refrigerator are formed at a sharp right angle according to the prior art. The maximum rotational radius of the door while being opened is the distance from one top edge to the other top edge. Accordingly, the door of the refrigerator in the related art requires a very wide space for opening the door.

Furthermore, when the refrigerator is installed at a tight space, the edge of the door may bump against a wall or other structure, and a hand or a foot may be caught between the door and the wall.

Accordingly, it is advantageous to decrease the amount of space necessary to accommodate opening the door of the refrigerator. Preventive measures are needed to reduce the risk of accident or injury when a hand or other body part is caught between the door and a wall when the door is opened.

SUMMARY

Provided herein is a refrigerator design having curved door edges, thereby decreasing a rotational radius of the doors, and a method of manufacturing the same.

Some embodiments of the present invention further provide a refrigerator design having curved door edges that do not reduce the durability of the door, and a method of manufacturing the same.

Additional embodiments of the present invention provide a refrigerator where an exterior material of a door and an interior material of the door are easily assembled and mitigates a spring back phenomenon that is generated in the exterior material of the door when an edge of the door is curved, and a method of manufacturing the same.

Technical problems to be achieved in the present disclosure are not limited to the aforementioned technical problem, and any other not-mentioned technical problem will be obviously understood from the description below by those skilled in the technical field to which the present disclosure pertains.

An exemplary embodiment of the present disclosure provides a refrigerator including a cabinet comprising a storage chamber, a door on an outer surface of the cabinet, wherein opening the door provides access to the storage chamber and closing the door closes the storage chamber, a hinge unit coupled to the outer surface of the cabinet and to a surface of the door, where an edge of the door is curved, and wherein a first radius of a first curvature of the edge at a lower portion of the door is smaller than a second radius of a second curvature of the edge at an upper portion of the door.

Another exemplary embodiment of the present disclosure provides a method of manufacturing a refrigerator, including molding a door comprising a door edge from an external material, where a first curvature radius of an upper portion of the door edge is greater than a second curvature radius of a lower portion of the door edge, coupling the exterior material to a lower zig, injecting a liquid heat insulation material into the exterior material, coupling an upper zig (to which an interior material is fixed) to the lower zig, foaming the liquid heat insulation material to form an air layer; and hardening the foamed liquid heat insulation material.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
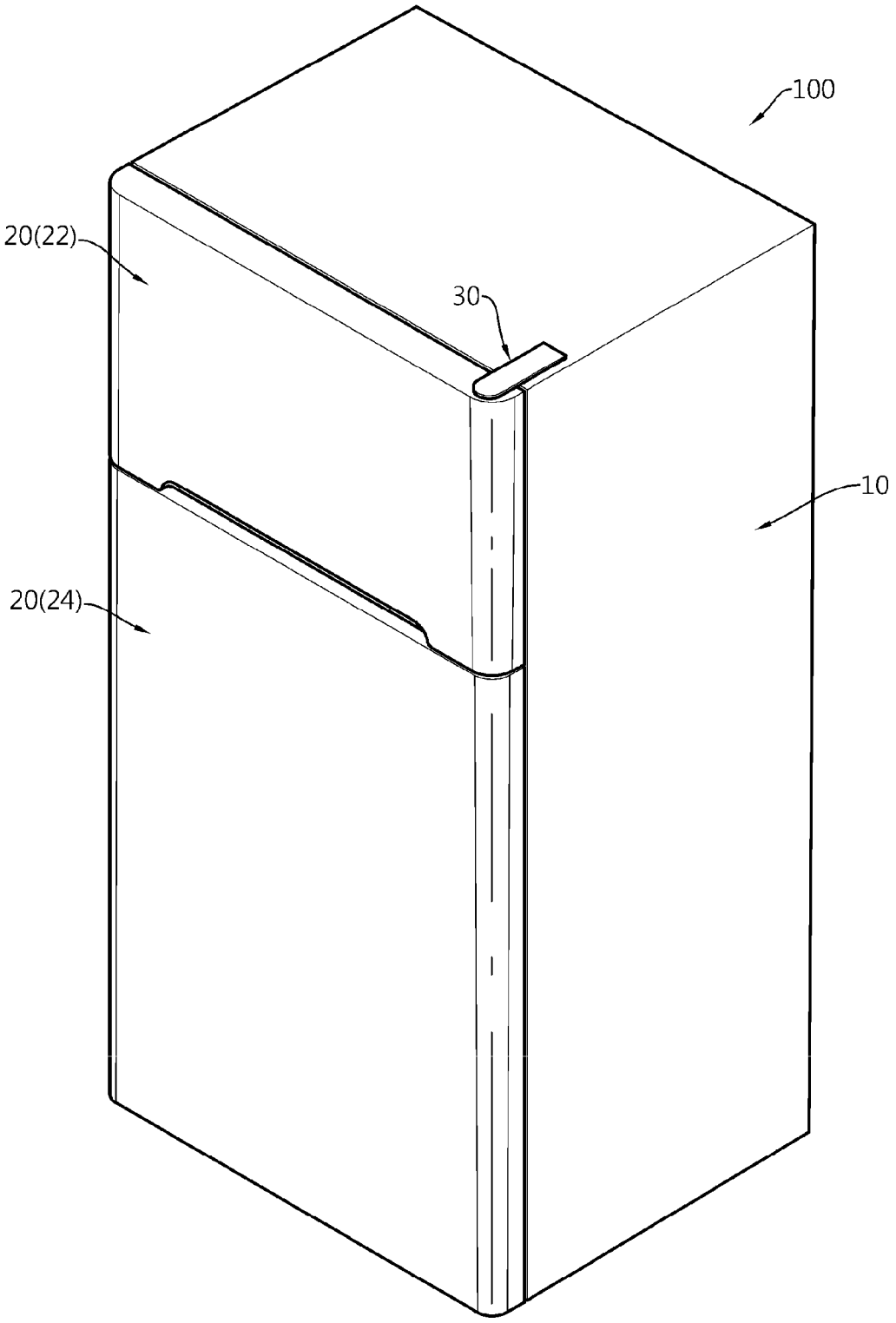
FIG. 1 is a diagram illustrating an exemplary refrigerator according to embodiments of the present disclosure.

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

Advantages and features of the present disclosure and methods of achieving the advantages and features will be clear with reference to exemplary embodiments described in detail below together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be modified to be variously carried out differently from the exemplary embodiment described herein. In the following description of the exemplary embodiment, a detailed description of known configurations or functions incorporated herein will be omitted when it is determined that the detailed description may make the subject matter of the present disclosure unclear. For helping the understanding of the present disclosure, the accompanying drawings are not illustrated based on actual scales, but parts of the constituent elements may be exaggerated in terms of sizes.

The terms used in the description are defined considering the functions of the present disclosure and may vary depending on the intention or usual practice of a manufacturer. Therefore, the definitions should be made based on the entire contents of the present specification.

Like reference numerals indicate like elements throughout the specification. Hereinafter, an exemplary refrigerator will be described with reference to FIGS. 1 to 6 according to embodiments of the present disclosure. The exemplary refrigerator disclosed herein may be used for cold storing objects (e.g., food and other perishable items).

Figure 2:
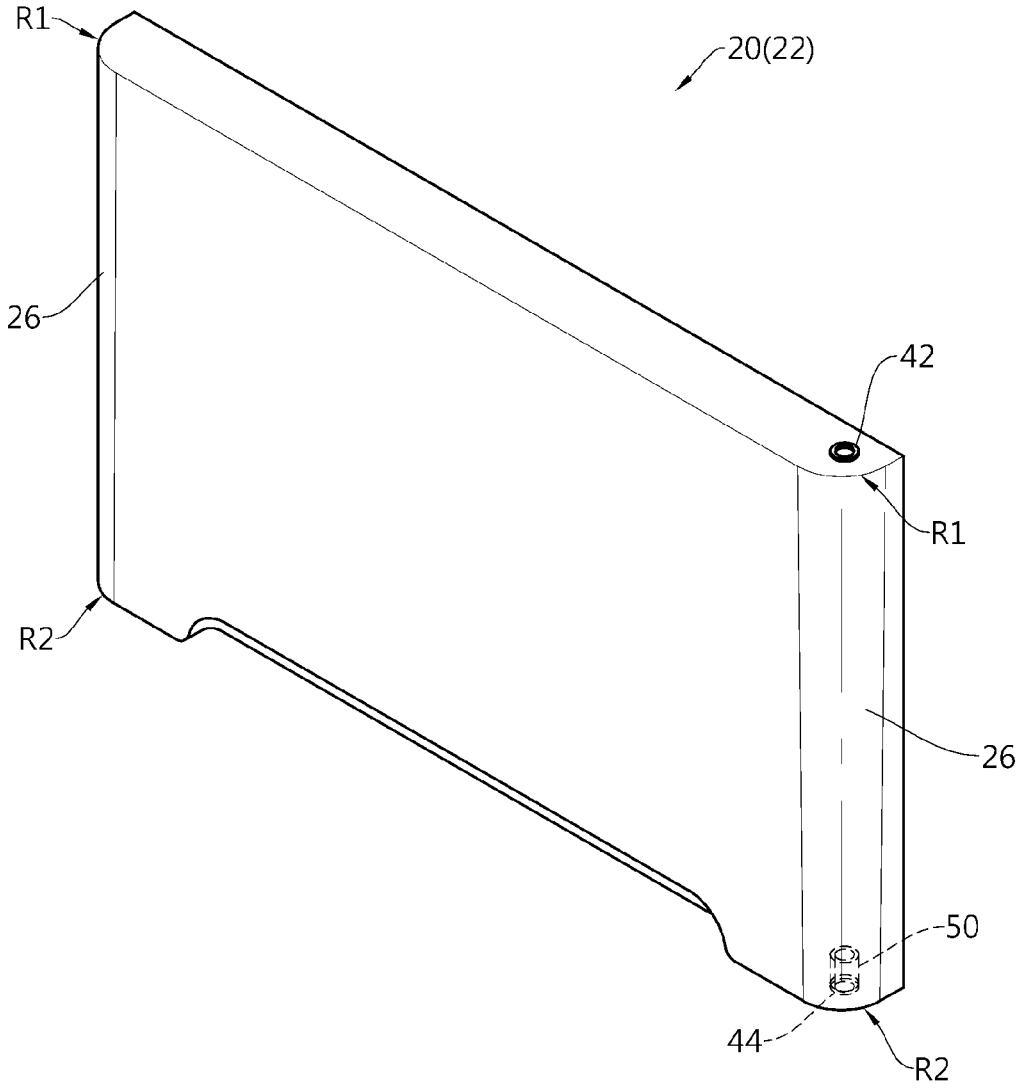
FIG. 2 is a diagram illustrating an exemplary first door of a refrigerator according to embodiments of the present disclosure.

With regard to FIG. 1, an exemplary refrigerator 100 is depicted according to embodiments of the present disclosure. Doors 20(22) and 20(24) are fastened to a front surface or portion of a cabinet 10 of refrigerator 100 using a hinge unit 30. Hereinafter, Doors 20 refers to Doors 20(22) and 20(24). The cabinet 10 comprises an interior storage chamber. The doors 20 may be opened to expose the storage chamber or closed to seal the storage chamber. The doors 20 are opened/closed by rotating the doors about hinge unit 30. Hinge unit 30 serves as an axis (e.g., a hinge or pivot) for the doors 20. The edges 26 of doors 20 are curved as depicted in FIG. 2. Doors 20 may comprise a first door 20(22) and a second door 20(24) that may be opened/closed independently, or doors 20 may comprise a single door. The first door 20(22) may be disposed at an upper side of the second door 20(24).

Figure 3:
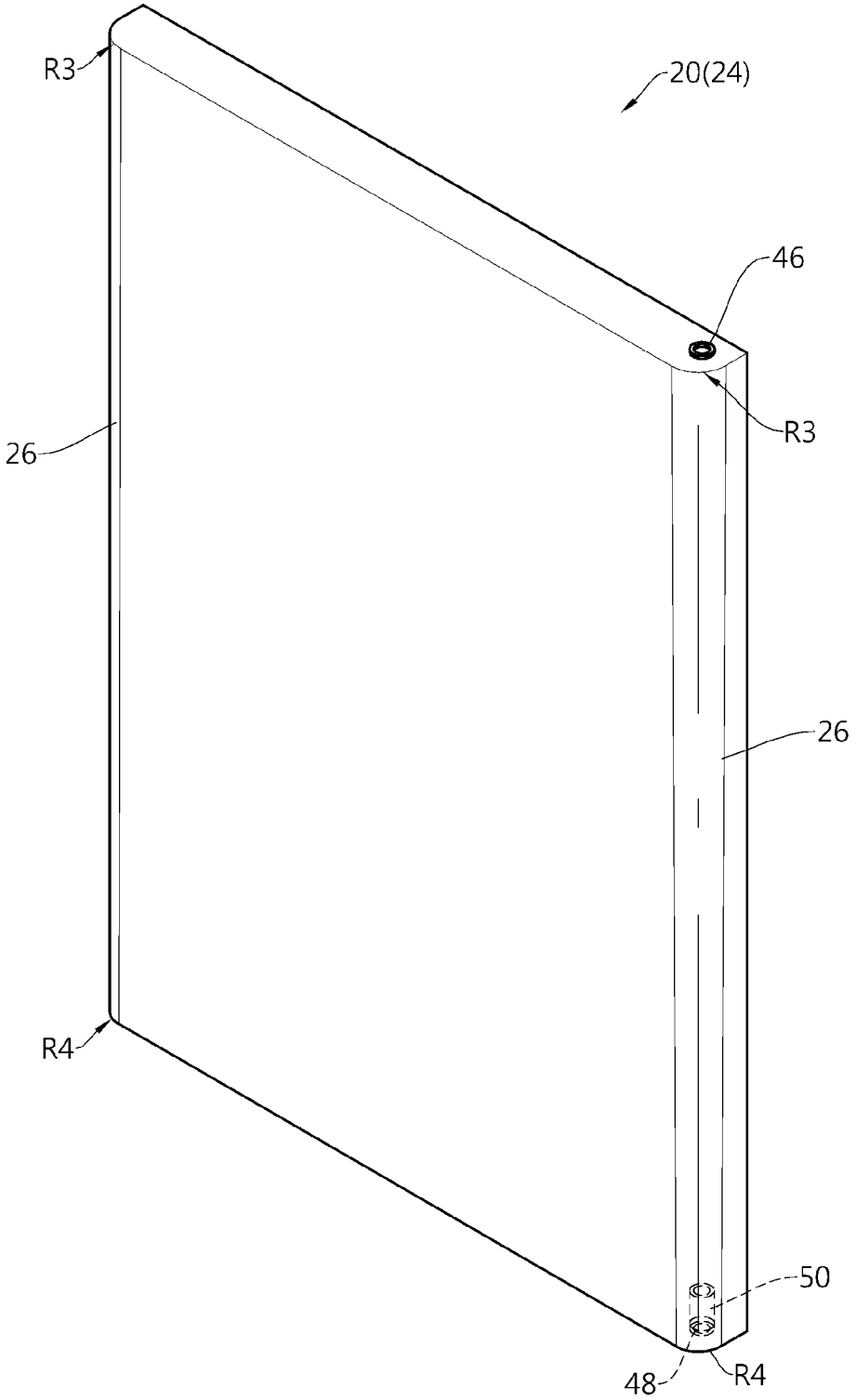
FIG. 3 is a diagram illustrating an exemplary second door of a refrigerator according to embodiments of the present disclosure

As illustrated in FIGS. 2 and 3, hinge holes are formed at the doors 20. More particularly, first and second hinge holes 42 and 44 are formed at upper and lower sides of a first door 20(22), respectively, and third and fourth hinge holes 46 and 48 are formed at upper and lower sides of a second door 20(24), respectively. A hinge boss 23 of the hinge unit 30 may be located at the first, second, third, and/or fourth hinge holes 42, 44, 46, and 48.

Figure 4:
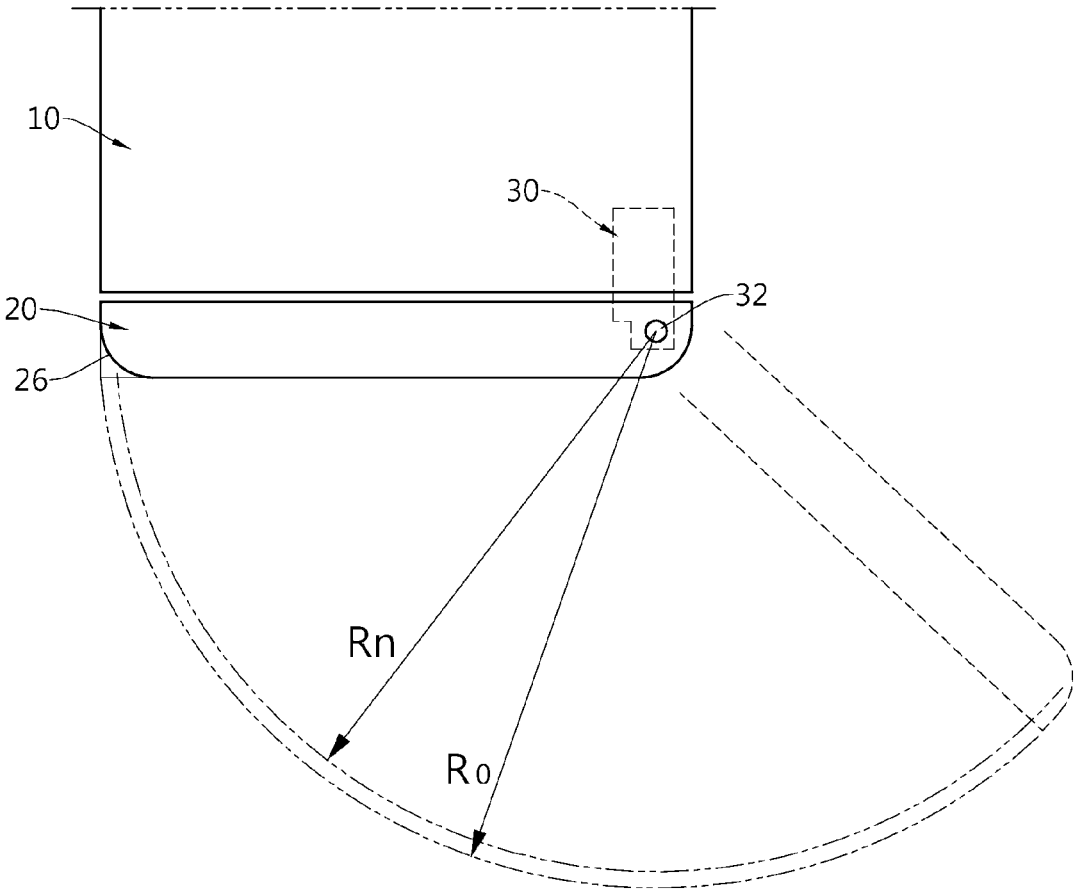
FIG. 4 is a diagram illustrating an exemplary space occupied when opening an exemplary door of a refrigerator according to the embodiments of the present disclosure.

As illustrated in FIG. 4, door radiuses Rn and Ro are formed when the doors 20 are opened. Rn represents a distance from a hinge shaft 32 to the curved portion of door edge 26 and is smaller than a second door radius, Ro, which represents a distance from hinge shaft 32 to a portion of the door edge 26 that is not curved.

Accordingly, it is possible to decrease the door radius when the doors 20 are opened according to embodiments of the present invention. Furthermore, it is possible to decrease an amount of space required when the doors 20 of the refrigerator are opened/closed.

When the doors of a refrigerator according to the prior art are opened, a body part, such as a hand or a foot of a user, may become caught between the doors and a wall or another structure. According to embodiments of the present invention, a portion of door edges 26 of door 20 are curved where they may contact a body part. As such, an impact caused by the door edge 26 of the doors 20 is not forcefully applied to the body part of the user because advantageously no sharp angles are present.

According to some embodiments of the present invention, a curvature of an upper side of the door edge 26 may be different than a curvature of a lower side of the door edge 26. More particularly, a radius of the curvature of the door edge 26 at the lower side of the doors 20 may be smaller than a radius of the curvature of the door edge 26 at the upper side of the doors 20.

Figure 5:
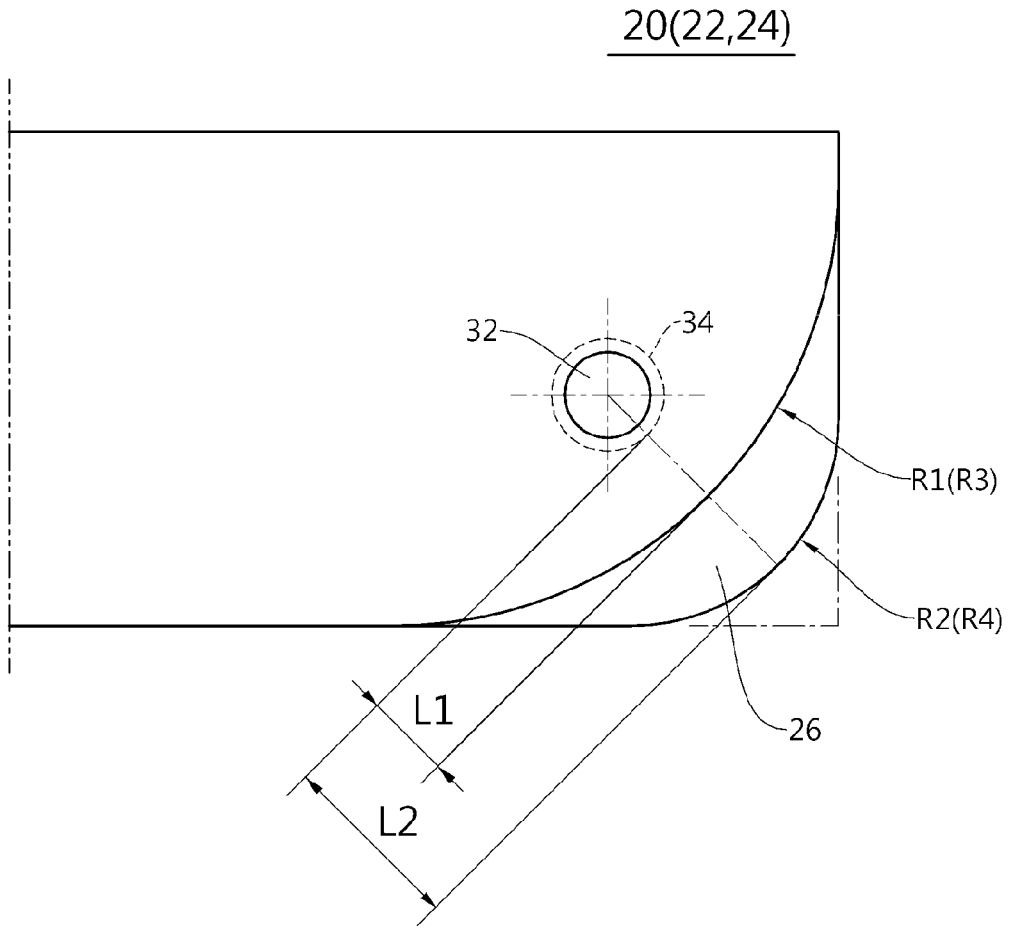
FIG. 5 is a diagram illustrating an exemplary door of a refrigerator according to embodiment of the present disclosure.

A curvature of a door edge of a refrigerator door may affect durability of the door. As illustrated in FIG. 5, when a radius of the curvature of the doors 20 is small, a hinge unit requires less thickness. According to embodiments of the present disclosure, door 20 secures a sufficient thickness at the hinge unit, thereby providing excellent durability of the door 20.

As illustrated in FIGS. 2 and 3, a reinforcing member 50 may be provided in door 20 to couple with the hinge unit 30 and to provide further structural support.

According to some embodiments of the present invention, hinge boss 34 of the hinge unit 30 may comprise reinforcing member 50. A load applied by the door 20 is applied to the hinge unit 30 through the reinforcing member 50 when the door 20 is opened/closed. Accordingly, the reinforcing member 50 provides strength and support for the door 20 and hinge unit 30.

The reinforcing member 50 may be located at a lower side of the door 20 to strengthen a bottom part of the door 20 to which the greatest load is applied. This further enhances the strength of the door 20 and hinge unit 30.

According to some embodiments, the doors 20 may comprise a first door 22 and a second door 24.

With regard to FIG. 5, for the first door 20(22), a second radius R2 at the lower side of the door 22 is smaller than a first radius R1 at the upper side of the door 20(22). For the second door 20(24), a fourth radius R4 at the lower side of the door 20(24) is formed to be smaller than a third radius R3 at the upper side of the door 20(24).

Even though two doors 20(22) and 20(24) are disposed at the upper and lower sides, it is possible to decrease the radiuses of the opening of the doors according to embodiments of the present invention. When the radiuses at the lower sides of the first and second doors 20(22) and 20(24) are smaller than the radiuses at the uppers sides of the first and second doors 20(22) and 20(24), the strength of the hinge unit is improved thereby providing excellent durability of the first and second doors 20(22) and 20(24).

Alternatively, the first door 20(22) may be disposed at the upper side of cabinet 10, and the second door 20(24) may be disposed at the lower side of cabinet 10. In this case, an average curvature of the door edges of the second door 20(24) may be smaller than an average curvature of the door edges of the first door 20(22). Here, the average curvature means an average of the largest curvature and the smallest curvature.

Accordingly, the second door 20(24) disposed at the lower side of cabinet 10 may further enhance the strength of the hinge unit. On the other hand, the second door 20(22) disposed at the upper side of cabinet 10 has a large average curvature so that it is possible to further decrease an opening/closing radius when the door is opened/closed.

The third radius R3 of the second door 20(24) may be smaller than the second radius R2 of the first door 20(22).

Accordingly, the external appearance of the doors 20 may have a shape in which the door edge of the first door 20(22) and the door edge of the second door 20(24) appear continuous and give an impression of stability.

According to some embodiments of the present invention, a hinge shaft 32 may be inserted into the hinge boss 34 of hinge unit 30. A first distance L1 is measured from the hinge boss 34 to a surface of the door edge 26 at an upper side of the door 20, and a second distance L2 is measured from the hinge boss 34 to a surface of the door edge 26 at a lower side of the doors 20. According to some embodiments, the second distance L2 may be greater than the first distance L1.

As illustrated in FIG. 5, when a shortest distance from the hinge boss 34 to a surface of the door edge 26 is great, the hinge unit comprises a thick hinge unit. The thick hinge unit provides strength and excellent durability to doors 20.

Figure 7:
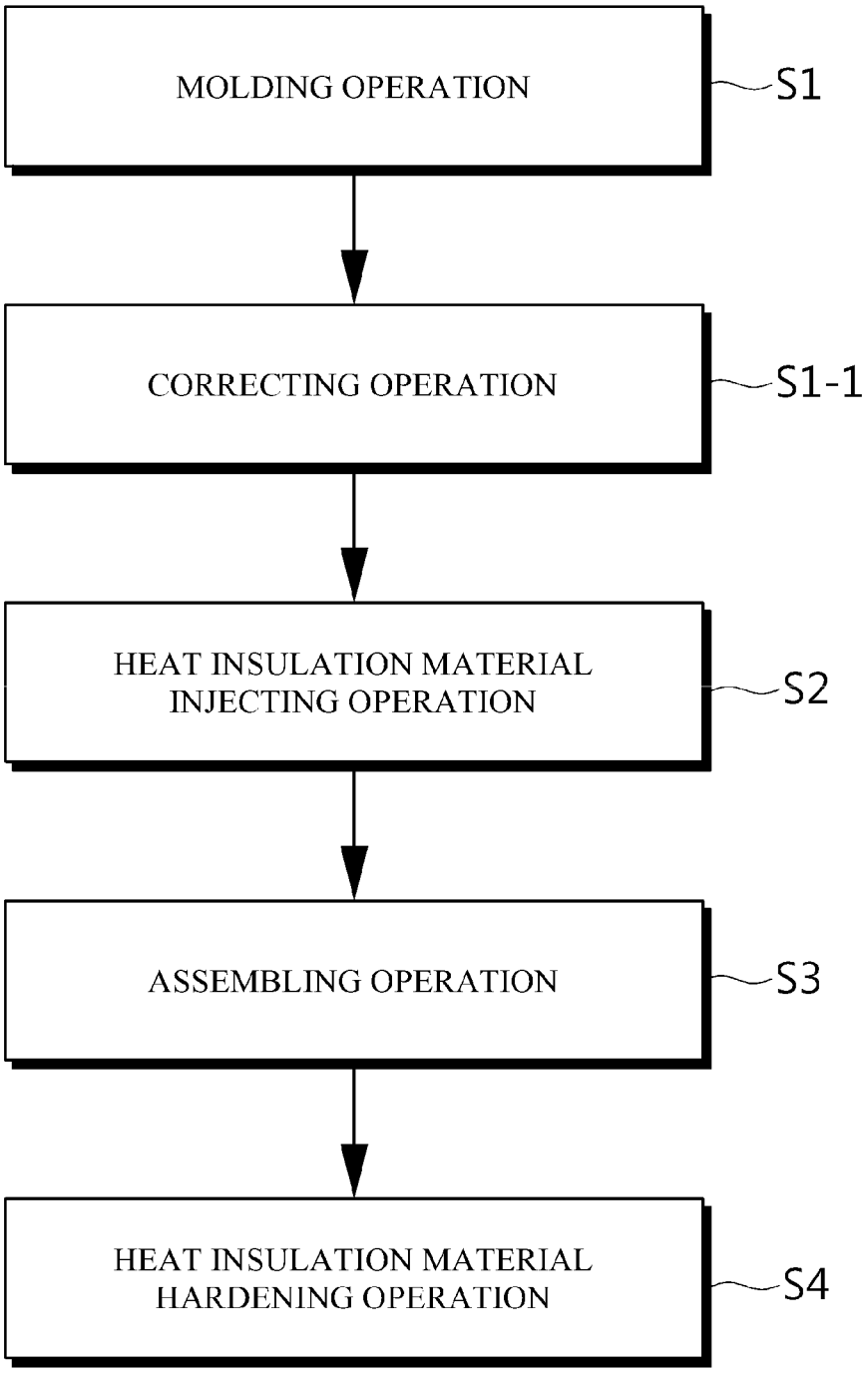
FIG. 7 is a flowchart illustrating an exemplary sequence of steps for of manufacturing an exemplary refrigerator according to embodiments of the present disclosure.

With regard to FIG. 7, a flowchart illustrating an exemplary sequence of steps for manufacturing a refrigerator is depicted according to embodiments of the present disclosure.

Hereinafter, exemplary steps S1 to S4 for manufacturing a refrigerator according to embodiment of the present disclosure are described in turn.

First operation (S1): The first operation comprises molding an exterior material of the door 20 wherein the door edges 26 of the doors 20 are molded so that a radius of a curvature of an upper side of the doors 20 is greater than a radius of a curvature of a part of a lower side of the doors 20. In other words, a flat metal material is molded to form an external shape of the doors 20. Particularly, door edge 26 of the doors 20 is curved and the curvature gradually increased from a small size to a great size.

Second operation (S2): The second operation comprises injecting a liquid heat insulation material into the exterior material molded in the first operation. The liquid heat insulation material is foamed to form an air layer which improves a heat insulation effect of the doors.

Third operation (S3): The third operation comprises assembling the exterior material molded in the first operation with an interior material that is manufactured by using known techniques.

Fourth operation (S4): The fourth operation comprises foaming the liquid heat insulation material to form an air layer, and hardening the foamed liquid heat insulation material such that it is set in place.

As described above, according to embodiments of the present invention, it is possible to form a curvature at the door edge 26 of the doors 20 when the exterior material of the doors 20 is molded to decrease an opening/closing radius of the doors 20 when the doors 20 is manufactured and assembled with the cabinet 10. The door edge 26 has a curvature, so that the door edge 26 is not sharp, thereby preventing an accident or injury caused when a body part of a user contacts the doors 20.

According to some embodiments, the curvature of door edge 26 gradually increases from a small size to a greater size to mitigate a spring back phenomenon caused when manufacturing a curvature. In addition, the spring back phenomenon is relatively small for a small curvature when compared to the spring back phenomenon of a great curvature. Accordingly, the door edge 26 decreases the spring back phenomenon in the curvatures by using a small curvature. Therefore, it is possible to solve the known problems in assembling the door of the refrigerator due to the spring back phenomenon when the exterior material is assembled with the interior material.

Figure 6:
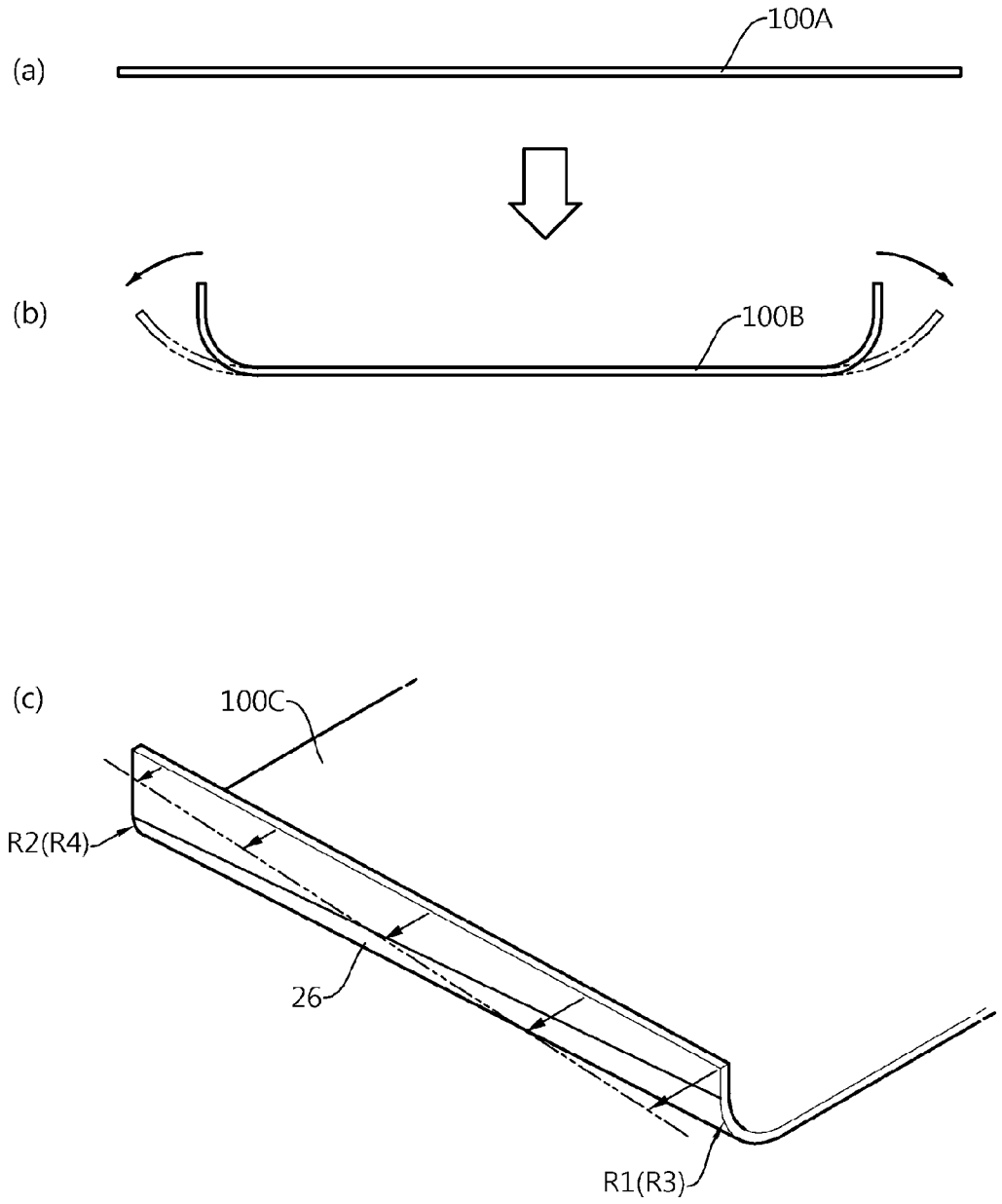
FIG. 6 is a diagram illustrating a spring back phenomenon of an exemplary method of manufacturing a refrigerator according to embodiments of the present disclosure.

According to some embodiments, the method of manufacturing a refrigerator may further include an operation (S1-1) for correcting the spring back phenomenon of the exterior material. As illustrated in FIG. 6, the spring back phenomenon occurs when a metal material is molded (e.g., bent). Accordingly, the exterior material and the interior material are assembled by correcting a distortion in the materials caused by the spring back phenomenon.

Alternatively, according to some embodiments of the present disclosure, the third operation (S3) may be performed before the second operation (S2). Accordingly, the liquid heat insulation material is injected and foamed after the exterior material and the interior material are assembled, thereby preventing excessive liquid heat insulation material from being injected. That is, it is possible to prevent the liquid heat insulation material from being unnecessarily wasted.

Hereinafter, a second method of manufacturing the refrigerator according to an embodiment of the present disclosure will be described for each operation, and descriptions of constituent elements overlapping those of the exemplary embodiment of the present disclosure will be omitted.

According to the second method, an exterior material is first provided, and the exterior material is fixed to a lower zig. A liquid heat insulation material is injected into the exterior material. Then, an upper zig, to which an interior material is fixed, is coupled and fixed to the lower zig. The liquid heat insulation material is then foamed so that an air layer is formed, and the liquid heat insulation material is hardened over a period of time.

A curvature of an upper portion of the external material of the door edge 26 of the doors 20 is molded to be greater than a curvature a lower portion of the interior material which is to be a lower side of the door.

Alternatively, the step of providing the exterior material in the second method may comprise correcting a spring back phenomenon of the exterior material, thus making it easier to couple the lower zig to the upper zig.

Alternatively, second method may comprise injecting the liquid heat insulation material after the upper zig and the lower zig are coupled to each other. Accordingly, it is possible to prevent excessively liquid heat insulation material from being injected.

The exemplary embodiments of the present disclosure have been described with reference to the accompanying drawings, but those skilled in the art will understand that the present disclosure may be implemented in another specific form without changing the technical spirit or an essential feature thereof.

Accordingly, it should be understood that the aforementioned exemplary embodiment is described for illustration in all aspects and are not limited, and the scope of the present disclosure shall be represented by the claims to be described below, and it should be construed that all of the changes or modified forms induced from the meaning and the scope of the claims, and an equivalent concept thereto are included in the scope of the present disclosure. From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A refrigerator, comprising:

a cabinet comprising a storage chamber;

a door disposed on an outer surface of the cabinet, wherein when open the door provides access to the storage chamber and when closed the door closes the storage chamber; and a hinge unit coupled to the outer surface of the cabinet and coupled to a surface of the door, wherein an edge of the door is curved, and a first radius of a first curvature of the edge at a lower portion of the door is smaller than a second radius of a second curvature of the edge at an upper portion of the door, wherein the door comprises a first door and a second door, and wherein:

the first door is above the second door;

a second radius at a second lower portion of the first door is smaller than a first radius of a second upper portion of the first door; and a fourth radius at a third lower portion of the second door is smaller than a fourth radius of a third upper portion of the second door.

2. The refrigerator of claim 1, further comprising a reinforcing member between the hinge unit and the door.

3. The refrigerator of claim 2, wherein the reinforcing member is disposed at the lower portion of the door.

4. The refrigerator of claim 1, wherein an average curvature of edges of the second door is smaller than an average curvature of edges of the first door.

5. The refrigerator of claim 1, wherein the third radius of the second door is smaller than the second radius of the first door.

6. A refrigerator, comprising:

a cabinet comprising a storage chamber;

a door disposed on an outer surface of the cabinet, wherein when open the door provides access to the storage chamber and when closed the door closes the storage chamber; and a hinge unit coupled to the outer surface of the cabinet and coupled to a surface of the door, wherein an edge of the door is curved, and a first radius of a first curvature of the edge at a lower portion of the door is smaller than a second radius of a second curvature of the edge at an upper portion of the door, and a hinge shaft in a hinge boss coupled to the hinge unit, wherein a first distance from the hinge boss to a surface of the door edge at the upper side of the door is greater than a second distance from the hinge boss to the surface of the door edge at the lower side of the door.

* * * * *